US009082375B2

(12) United States Patent
Mori

(10) Patent No.: US 9,082,375 B2
(45) Date of Patent: Jul. 14, 2015

(54) PERCUSSION INSTRUMENT AND STAND FOR THE SAME

(71) Applicant: ROLAND CORPORATION, Shizuoka (JP)

(72) Inventor: Yoshiaki Mori, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 0 days.

(21) Appl. No.: 14/480,647

(22) Filed: Sep. 9, 2014

(65) Prior Publication Data

US 2014/0373700 A1 Dec. 25, 2014

Related U.S. Application Data

(63) Continuation of application No. 14/011,727, filed on Aug. 27, 2013, now Pat. No. 8,865,987.

(30) Foreign Application Priority Data

Oct. 31, 2012 (JP) ..... 2012-241341

(51) Int. Cl.
*G10D 13/02* (2006.01)
*G10H 1/32* (2006.01)

(52) U.S. Cl.
CPC ..... *G10D 13/02* (2013.01); *G10D 13/025* (2013.01); *G10H 1/32* (2013.01); *G10H 2230/275* (2013.01)

(58) Field of Classification Search
CPC .... G10D 13/02; G10D 13/023; G10D 13/029
USPC ..... 84/411 R
See application file for complete search history.

(56) References Cited

U.S. PATENT DOCUMENTS

| | | | |
|---|---|---|---|
| 4,319,514 | A | 3/1982 | Donohoe |
| 4,479,414 | A | 10/1984 | Willis |
| 7,642,440 | B2 | 1/2010 | Bailey |
| 7,732,692 | B2 | 6/2010 | Mori et al. |
| 7,915,507 | B2 | 3/2011 | Onheiser |
| 8,093,478 | B2 | 1/2012 | Bailey |

FOREIGN PATENT DOCUMENTS

| | | | |
|---|---|---|---|
| EP | 1973097 A2 * | 9/2008 | ..... G10D 3/00 |
| JP | 2009-265619 | 11/2009 | |

OTHER PUBLICATIONS

"http://www.chamberlainmusic.com/ProductDetail.asp?ProductID=TD502" retrived on Aug. 9, 2012, p. 1-2, which is the web-site from "Chamberlain music" shows TD502 Percussion Practice Kit by Percussion Workshop; the Catalogue No. TD502.

"http://usa.yamaha.com/products/musical-instruments/drums/el-drumkit/dtx900/dtx900k/?mode=model" retrived on Jul. 13, 2012, p. 1-3, which is the web-site from "YAMAHA United States" shows Electronic Drum System by YAMAHA; the series No. DTX900K.

"http://www.dwdrums.com/smartpractice/specialty.asp" retrived on Aug. 9, 2012, p. 1-2, which is the web-site from "Drum Workshop" shows Go AnywhereTM 5-Piece Practice Set; item No. DWCP-PADTS5.

* cited by examiner

*Primary Examiner* — Kimberly Lockett
(74) *Attorney, Agent, or Firm* — Jianq Chyun IP Office

(57) ABSTRACT

A percussion instrument includes at least one pad and a support frame supporting the pad. The support frame includes a central vertical frame, a left vertical frame located in a left rear direction of the central vertical frame when viewed from the player side, a right vertical frame located in a right rear direction of the central vertical frame when viewed from the player side, a left transverse frame extending between the central vertical frame and the left vertical frame and connecting the central vertical frame with the left vertical frame, and a right transverse frame extending between the central vertical frame and the right vertical frame and connecting the central vertical frame with the right vertical frame.

20 Claims, 9 Drawing Sheets

PERCUSSION INSTRUMENT AND STAND FOR THE SAME

CROSS-REFERENCE TO RELATED APPLICATIONS

This is a continuation application of and claims the priority benefit of U.S. application Ser. No. 14/011,727, filed on Aug. 27, 2013, now allowed, which claims the priority benefit of Japan application serial no. 2012-241341, filed on Oct. 31, 2012. The entirety of each of the above-mentioned patent applications is hereby incorporated by reference herein and made a part of this specification.

BACKGROUND OF THE INVENTION

1. Field of the Invention

The present invention relates to a percussion instrument and a stand for the same. In particular, the present invention relates to a percussion instrument that effectively utilizes the space at the feet of the player and has improved stability when played and a stand for the percussion instrument.

2. Description of Related Art

A conventional electronic percussion instrument is known to include an arm extended from a support frame and various pad devices connected to the arm. For example, in the electronic percussion instrument disclosed in the below-listed Patent Literature 1, two parallel-arranged posts are joined by a transverse pipe therebetween, and an arm is extended from the transverse pipe and the posts. In addition, various types of pad devices are connected to the arm.

Moreover, when the pad devices are hit, the support frame of the electronic percussion instrument is likely to tilt and fall toward the side of the player. Considering this, the below-listed Patent Literature 1 discloses installing a support member to extend from the feet of the posts toward the player side.

However, the installation of the support member that is extended from the feet of the posts toward the player side may cause some problems, such as hindering the player, and may limit the positions of various pedals that are to be arranged at the feet.

In view of the above, the present invention provides a percussion instrument that effectively utilizes the space at the feet of the player and has improved stability when played.

PRIOR ART LITERATURE

Patent Literature

[Patent Literature 1] Japanese Patent Publication No. 2009-265619

SUMMARY OF THE INVENTION

A percussion instrument according to the present invention provides the following effects. A support frame is composed of a central vertical frame, a left vertical frame located in a left rear direction relative to the central vertical frame, and a right vertical frame located in a right rear direction relative to the central vertical frame. Moreover, the central vertical frame and the left vertical frame are connected by a left transverse frame, and the central vertical frame and the right vertical frame are connected by a right transverse frame. That is, the support frame is set up like the letter "V" with the central vertical frame installed on the side of the player at the vertex of the "V." Accordingly, there is space on two sides of the central vertical frame (near a base of the left vertical frame and near a base of the right vertical frame). That is, when the player plays the percussion instrument with his feet open on two sides of the central vertical frame, there is space right around the feet of the player, and the space can be used effectively.

According to other aspects of the present invention, in addition to the aforementioned effects of the above percussion instrument, the percussion instrument further provides the following effects. A side vertical frame and a first arm are connected in a way that at least one of the side vertical frame and the first arm is rotatable around a vertical axis of the side vertical frame, such that at least one of the side vertical frame and the first arm can be rotated around the vertical axis of the side vertical frame. Accordingly, in the vertical direction, the first arm can be folded to be approximately parallel to the left transverse frame or the right transverse frame. Besides, the first arm and a pad connected to the first arm are connected in a way that at least one of the first arm and the pad is rotatable around a horizontal axis of the first arm, such that at least one of the first arm and the pad connected to the first arm can be rotated around the horizontal axis of the first arm. Accordingly, a pad head of the pad can be adjusted to be approximately parallel to the vertical direction. Furthermore, the left transverse frame and the right transverse frame are connected in a way that at least one of the left transverse frame and the right transverse frame is rotatable around the central vertical frame, which serves as the axis, so that at least one of the left transverse frame and the right transverse frame can be rotated around the central vertical frame. Thus, an angle between the left transverse frame and the right transverse frame can be adjusted smaller. Moreover, in the vertical direction, the first arm can be folded to be approximately parallel to the left transverse frame or the right transverse frame, and the pad head of the pad connected to the first arm can be adjusted to be approximately parallel to the vertical direction. Namely, the first arm with the pad connected thereto can be folded between the left transverse frame and the right transverse frame, so as to fold the electronic drum set 10 compactly in the width direction.

According to other aspects of the present invention, in addition to the aforementioned effects of the above percussion instrument, the percussion instrument further provides the following effects. When the first arm and a second arm are connected with the side vertical frame, the respective lengths from the side vertical frame to the pads on the first and second arms can be adjusted to differ from each other, or the pads are unadjustably fixed on the first and the second arms respectively in a way that the lengths from the side vertical frame to the pads differ from each other. Accordingly, when the first arm and the second arm are slid along the side vertical frame to a position where the pads of the first arm and the second arm overlap in the vertical direction, the overlap of the pads in the width direction can be reduced. Thus, the electronic drum set 10 can be folded more compactly in the width direction.

According to other aspects of the present invention, in addition to the aforementioned effects of the above percussion instrument, the percussion instrument further provides the following effects. A portion of the side vertical frame, to which the first arm and the second arm are connected, is rotatable around the vertical axis of the side vertical frame. Thus, one of the first arm and the second arm can be welded to the side vertical frame, and in that case, the production costs of the support frame are lower in comparison with the case that both the first and the second arms are rotatably connected with the side vertical frame.

According to other aspects of the present invention, in addition to the aforementioned effects of the above percussion instrument, the percussion instrument further provides the following effects. One of the left transverse frame and the right transverse frame is welded to the central vertical frame while the other is rotatable around the central vertical frame. Thus, the production costs of the support frame can be lowered in comparison with the case that both the left transverse frame and the right transverse frame are rotatably connected with the center vertical frame.

According to other aspects of the present invention, in addition to the aforementioned effects of the above percussion instrument, the percussion instrument further provides the following effects. The support frame is set up like the letter "V" with the central vertical frame installed on the side of the player at the vertex of "V." Thus, there is space right at the feet of the player. An attachment for installing a kick pedal is connected in the space, namely, connected to the base of the left vertical frame or the right vertical frame. Accordingly, the kick pedal, configured for hitting the pad connected to the left or right vertical frame when kicked by the foot of the player, can be installed to the attachment, which is handy for the player.

According to other aspects of the present invention, in addition to the aforementioned effects of the above percussion instrument, the percussion instrument further provides the following effects. A projection, which protrudes from at least one of the left and right transverse frames, can be inserted into an insertion hole formed to penetrate a cymbal pad. Therefore, the cymbal pad can be hung on at least one of the left and right transverse frames, so as to fold the electronic drum set 10 more compactly.

According to other aspects of the present invention, in addition to the aforementioned effects of the above percussion instrument, the percussion instrument further provides the following effects. A stopper, pressed on a front end part of a rod, includes a top part, a ventral part, and a bottom part arranged in sequence from a front end side of the rod. An external circumference of the top part is larger than a diameter of the insertion hole. An external circumference of the ventral part is smaller than a diameter of the top part. An external circumference of the bottom part is larger than the diameter of the top part. For this reason, when the front end part of the rod is inserted into or removed from the insertion hole of the cymbal pad, the top part of the stopper can be compressed to facilitate the installment/removal of the cymbal pad. In addition, the diameter of the bottom part is formed larger than the diameter of top part, such that the cymbal pad is securely locked to the bottom part of the stopper when installed.

According to other aspects of the present invention, in addition to the aforementioned effects of the above percussion instrument, a percussion instrument further provides the following effects. Provided that a first rod does not include an offset part, in order to install the cymbal pad at the same position, a base part of the first rod, which extends from the side vertical frame in the vertical direction, has to be extended to a juncture portion between the offset part of the first rod and a connection member. In that case, the size of the support frame increases. On the other hand, if the connection member is connected to one end of the base part of the first rod, a second rod becomes shorter, which may cause adverse influence on the vibration of the cymbal pad. Considering this, the first rod is provided with the offset part, so as to maintain the appropriate length of the second rod and at the same time prevent the size of the support frame from increasing. Even though the first rod is provided with the offset part, the first rod is rotatably connected with the side vertical frame, and therefore the offset part can be rotated between the left transverse frame and the right transverse frame when folded. Accordingly, the first rod does not protrude out in the width direction.

According to other aspects of the present invention, in addition to the aforementioned effects of the above percussion instrument, the percussion instrument further provides the following effects. For example, the first arm is connected to the left vertical frame and is rotatable around the left vertical frame. Because the first arm is shorter than the left transverse frame, by rotating the first arm around the left vertical frame, the first arm can be folded above the left transverse frame and the right transverse frame, so as to fold the electronic drum set 10 compactly in the width direction.

According to other aspects of the present invention, a stand for percussion instrument, supporting at least one pad is provided. The stand comprising: a central vertical frame installed upright in a vertical direction and grounded; a left vertical frame connected to the central vertical frame and installed upright in the vertical direction and located in a left rear direction relative to the central vertical frame and grounded; and a right vertical frame connected to the central vertical frame and installed upright in the vertical direction and located in a right rear direction relative to the central vertical frame and grounded.

DESCRIPTION OF THE EMBODIMENTS

Figure 1:
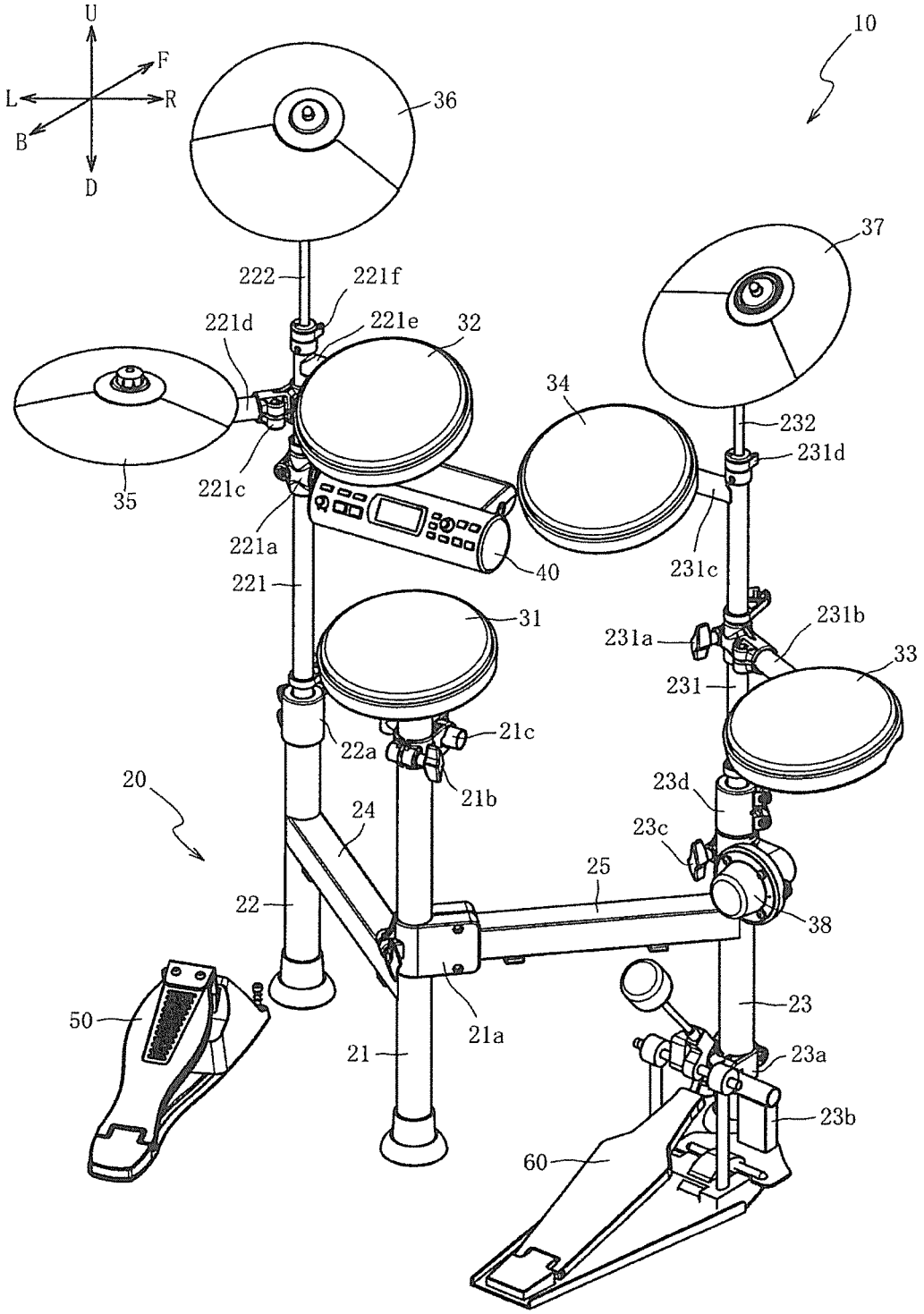
FIG. 1 is a perspective view of an electronic drum set.
Figure 2:
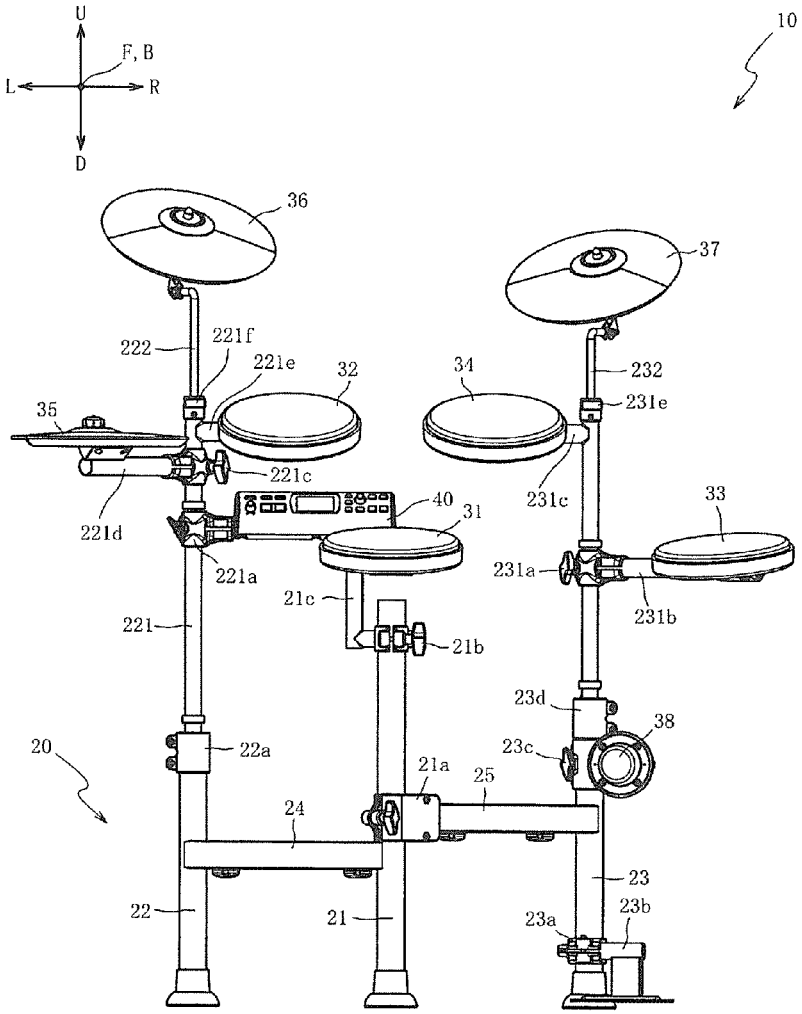
FIG. 2 is a front view of the electronic drum set.
Figure 3:
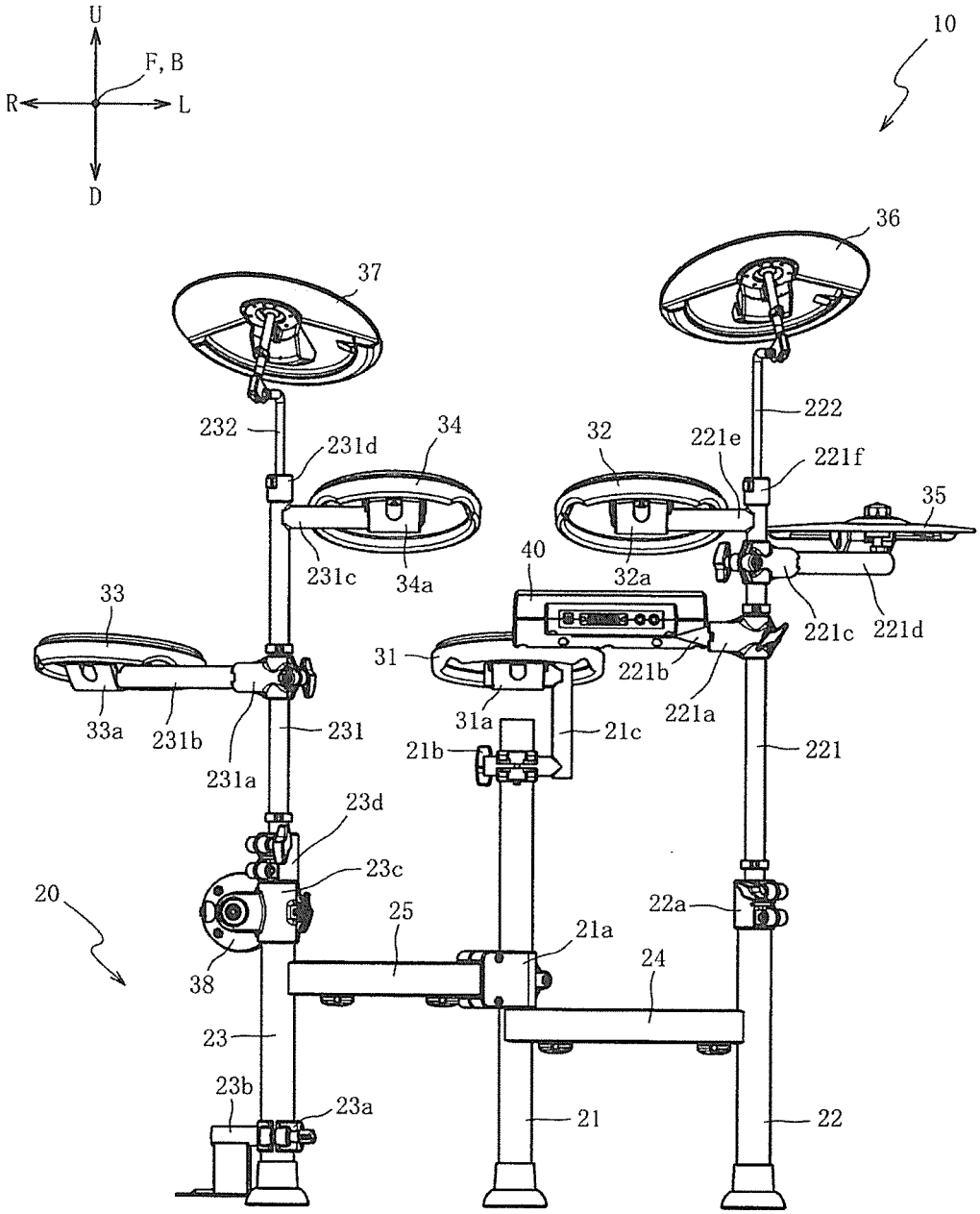
FIG. 3 is a rear view of the electronic drum set.

Preferable exemplary embodiments of the present invention are described in the following paragraphs with reference to the affixed drawings. First, the structure of an electronic drum set 10 is described with reference to FIG. 1 to FIG. 3. FIG. 1 is a perspective view of the electronic drum set 10, FIG. 2 is a front view of the electronic drum set 10, and FIG. 3 is a rear view of the electronic drum set 10. In addition, coordinate axes are provided at the upper left corner of each of FIG. 1 to FIG. 3 for illustrative purposes. In the coordinate axes, a direction that the player faces is defined as F, a direction opposite to the F direction is defined as B, a left direction from the aspect of the player is defined as L, a right direction is defined as R, a vertically upward direction is defined as U, and a vertically downward direction is defined as D. In addition, FIGS. 2 and 3 illustrate a state that a hi-hat control pedal 50 and a kick pedal 60 are removed from the electronic drum set 10.

The electronic drum set 10 senses the vibration that is generated when various pads 31-38 are hit, transmits an electrical signal corresponding to the vibration to a sound source 40 via a cable, and outputs an electronic sound corresponding to the electrical signal.

Principally, the electronic drum set 10 includes a stand 20, various types of pads, the sound source 40, the hi-hat control pedal 50, and the kick pedal 60. The aforementioned various pads are composed of a snare drum 31, a first torn 32, a second tom 33, a third tom 34, a hi-hat 35, a crash cymbal 36, a ride cymbal 37, and a kick pad 38.

The stand 20 supports the various pads 31-38, etc. Principally, the stand 20 includes a central post 21, a left post 22, a right post 23, a left transverse frame 24, and a right transverse frame 25. The left post 22 is located in a left rear direction relative to the central post 21, and the right post 23 is located in a right rear direction relative to the central post 21. The left transverse frame 24 connects the central post 21 and the left post 22. The right transverse frame 25 connects the central post 21 and the right post 23.

Two ends of the left transverse frame 24 are welded with the central post 21 and the left post 22. One end of the right transverse frame 25 is connected to the central post 21 by a handled clamp 21*a*, and the other end thereof is welded with the right post 23, such that, by loosening the handled clamp 21*a*, the right transverse frame 25 can be rotated around the central post 21, which serves as a rotation axis. Moreover, because the other parts are connected by welding, the production costs of the stand 20 are reduced and the strength of the stand 20 is enhanced.

A left vertical pipe 221 is connected to the top of the left post 22 by a clamp 22*a*. By loosening the clamp 22*a* using a specialized drum key, the left vertical pipe 221 can be rotated around a vertical axis of the left post 22. Additionally, the left vertical pipe 221 can be accommodated inside the left post 22.

Furthermore, a left vertical rod 222 is connected to the top of the left vertical pipe 221 by a clamp 221*f* provided with a lever. By loosening the clamp 221*f* provided with the lever, the left vertical rod 222 can be rotated around a vertical axis of the left vertical pipe 221. In addition, the left vertical rod 222 can be accommodated inside the left vertical pipe 221.

On the other side, the right post 23 is constructed the same as the left post 22. A right vertical pipe 231 is connected to the top of the right post 23 by a clamp 23*d*. By loosening the clamp 23*d* using a specialized drum key, the right vertical pipe 231 can be rotated around a vertical axis of the right post 23. And, the right vertical pipe 231 can be accommodated inside the right post 23.

Moreover, a right vertical rod 232 is connected to the top of the right vertical pipe 231 by a clamp 231*d* provided with a lever. By loosening the clamp 231*d* provided with the lever, the right vertical rod 232 can be rotated around a vertical axis of the right vertical pipe 231. In addition, the right vertical rod 232 can be accommodated inside the right vertical pipe 231.

Like this, the stand 20 is set up like the letter "V" with the central post 21, which is installed upright on the side of the player, at the vertex of "V". Thus, there is space on two sides of the central post 21 (near a base of the left post 22 and near a base of the right post 23), which can be effectively used. In addition, the right transverse frame 25 can be rotated with the central post 21 as the rotation axis by loosening the handled clamp 21*a*, so as to reduce an angle between the left transverse frame 21 and the right transverse frame 25 and fold the stand 20 compactly in the width direction thereof. Further to the above, the left vertical pipe 221, the left vertical rod 222, the right vertical pipe 231, and the right vertical rod 232 can be extended/retracted in the vertical direction to fold the stand 20 compactly in the height direction thereof.

Next, the various types of pads 31-38, etc., connected to the stand 20, will be described below. The snare drum 31 is connected to a top end of the central post 21 through a handled T-shaped clamp 21*b* and a U-shaped connection pipe 21*c* (see FIG. 3).

The handled T-shaped clamp 21*b* connects the central post 21 with the U-shaped connection pipe 21*c*. By loosening a handled screw, which fastens the central post 21, the U-shaped connection pipe 21*c* together with the snare drum 31 attached thereto can be rotated around the central post 21 which serves as the rotation axis. In addition, the U-shaped connection pipe 21*c* and the snare drum 31 attached thereto can be slid along the central post 21.

Moreover, a bolt that fastens a lower pipe of the U-shaped connection pipe 21*c* can be loosened using a specialized drum key (not shown in the figures, the same hereinafter). Accordingly, the U-shaped connection pipe 21*c* together with the snare drum 31 can be rotated with the lower pipe of the U-shaped connection pipe 21*c* as the rotation axis. Furthermore, a connection part 31*a* (see FIG. 3), through which an upper pipe of the U-shaped connection pipe 21*c* is inserted and which is fastened by a bolt, is provided at a rear side of the snare drum 31. By loosening the bolt with a specialized drum key, the snare drum 31 can be rotated around the upper pipe of the U-shaped connection pipe 21*c*, which serves as the rotation axis.

In this way, the snare drum 31 is positioned on top of the top end of the central post 21 and connected to the central post 21 through the handled T-shaped clamp 21*b* and the U-shaped connection pipe 21*c*. For this reason, a force brought by the hit on the snare drum 31 is absorbed by the central post 21 that is installed upright on the side of the player. Therefore, the stand 20 is prevented from tilting and falling toward the side of the player due to the hit on the snare drum 31. And, the stability of the stand 20 during performance is improved. In addition, generally the snare drum 31 is the pad that is hit more frequently than others, the connection of the snare drum 31 and the central post 21 is particularly effective in improving stability.

On another side, the hi-hat control pedal 50 is provided at the base of the left post 22. The stand 20 is set up like the letter "V" with the central post 21, which is installed on the side of the player, at the vertex of "V." Thus, there is space on two sides of the central post 21 (near the base of the left post 22 and near the base of the right post 23). That is, when the player plays the instrument with his feet open on two sides of the central post 21, there is space right at the feet of the player for installing the hi-hat control pedal 50, which is handy for the player.

In addition, the sound source 40, the hi-hat 35, and the first tom 32 are connected to the left vertical pipe 221 in sequence from the bottom to the top. The sound source 40 is connected with the left vertical pipe 221 by a handled T-shaped clamp 221*a*, which is connected to the left vertical pipe 221, and a transverse arm 221*b* (see FIG. 3). The handled T-shaped clamp 221*a* connects the left vertical pipe 221 and the transverse arm 221*b* (see FIG. 3). By loosening a handled screw, which fastens the left vertical pipe 221, the transverse arm

221*b* together with the sound source 40 can be rotated around the left vertical pipe 221, which serves as the rotation axis.

Moreover, the length of the transverse arm 221*b* (see FIG. 3), from the left vertical pipe 221 to a front end of the transverse arm 221*b*, is shorter than the length of the left transverse frame 24. Additionally, even when the sound source 40 is connected with the transverse arm 221*b*, the length from the left vertical pipe 221 to a front end of the sound source 40 (i.e. an edge part of the sound source 40, which is farthest from the left vertical pipe 221) is shorter than the left transverse frame 24. Thus, by rotating the transverse arm 221*b* together with the sound source 40 with the left vertical pipe 221 as the rotation axis, the transverse arm 221*b* and the sound source 40 can be folded above the left transverse frame 24, so as to fold the electronic drum set 10 compactly in the width direction thereof.

Besides, by loosening the bolt, which fastens the transverse arm 221*b*, with the specialized drum key, the transverse arm 221*b* together with the sound source 40 can be rotated around the axis of the transverse arm 221*b*, which extends in a horizontal direction, such that the sound source 40 can be folded to be approximately in parallel to a vertical direction, so as to be compact in the width direction.

The hi-hat 35 is connected with the left vertical pipe 221 by the transverse arm 221*d* and the handled T-shaped clamp 221*c*, which is connected to the left vertical pipe 221. The handled T-shaped clamp 221*c* connects the left vertical pipe 221 and the transverse arm 221*d*. By loosening the handled screw that fastens the left vertical pipe 221, the transverse arm 221*c* together with the hi-hat 35 can be rotated with the left vertical pipe 221 as the rotation axis.

Moreover, the length of the transverse arm 221*d*, from the left vertical pipe 221 to a front end of the transverse arm 221*d*, is shorter than the length of the left transverse frame 24. Additionally, the length from the left vertical pipe 221 to a front end of the hi-hat 35 (i.e. an edge part of the hi-hat 35, which is farthest from the left vertical pipe 221) is shorter than the left transverse frame 24. Accordingly, by rotating the transverse arm 221*d* together with the hi-hat 35 around the left vertical pipe 221 as the rotation axis, the transverse arm 221*d* and the hi-hat 35 can be folded above the left transverse frame 24, so as to fold the electronic drum set 10 compactly in the width direction thereof.

Besides, by loosening the bolt, which fastens the transverse arm 221*d*, with the specialized drum key, the transverse arm 221*d* together with the hi-hat 35 can be rotated around the axis of the transverse arm 221*d*, which extends in the horizontal direction, such that a drumhead of the hi-hat 35 can be folded to be approximately in parallel to the vertical direction, so as to fold the electronic drum set 10 compactly in the width direction.

The first tom 32 is connected with the left vertical pipe 221 by a transverse arm 221*e* having one end welded with the left vertical pipe 221. Because one end of the transverse arm 221*e* is welded with the left vertical pipe 221, the production costs of the stand 20 are reduced and the strength of the stand 20 can be further improved.

In addition, the length of the transverse arm 221*e*, from the left vertical pipe 221 to the front end of the transverse arm 221*e*, is shorter than the left transverse frame 24. Furthermore, as described below, the first torn 32 is made slidable along the transverse arm 221*e*. That is to say, the length from the left vertical pipe 221 to the front end of the first torn 32 (i.e. an edge part of the first tom 32, which is farthest from the left vertical pipe 221) can be adjusted to be shorter than the left transverse frame 24. And, as mentioned above, by using the specialized drum key to loosen the clamp 22*a*, the left vertical pipe 221 can be rotated around the vertical axis of the left post 22. Therefore, by rotating the left vertical pipe 221 around the vertical axis of the left post 22, the transverse arm 221*e* and the first tom 32 can be folded above the left transverse frame 24, so as to fold the electronic drum set 10 compactly in the width direction.

Moreover, a connection part 32*a* (see FIG. 3), through which the transverse arm 221*e* is inserted and which is fastened by a bolt, is provided at a rear side of the first torn 32. By loosening the bolt using the specialized drum key, the first tom 32 can be rotated around the axis of the transverse arm 221*e*, which extends in the horizontal direction, such that a drumhead of the first tom 32 can be folded to be approximately in parallel to the vertical direction, thereby folding the electronic drum set 10 compactly in the width direction.

Additionally, the first tom 32 can be slid along the transverse arm 221*e*. That is to say, the length from the left vertical pipe 221 to the first tom 32 (i.e. the length from a juncture base of the left vertical pipe 221 to the farthest edge part of the first torn 32) can be adjusted to be shorter than the length from the left vertical pipe 221 to the hi-hat 35. Accordingly, when the first tom 32 and the hi-hat 35 are folded, an overlap of the first tom 32 and the hi-hat 35 in the width direction can be reduced, and hence the electronic drum set 10 can be kept compact in size in the width direction when in the folded state.

Figure 4A:
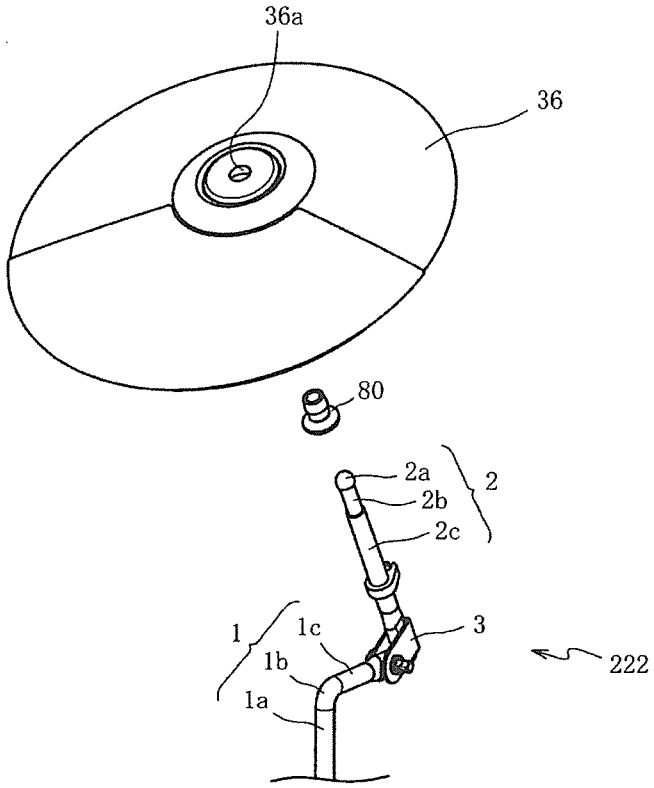
FIG. 4A is a perspective exploded view illustrating a left vertical rod, a stopper, and a crash cymbal.
Figure 4B:
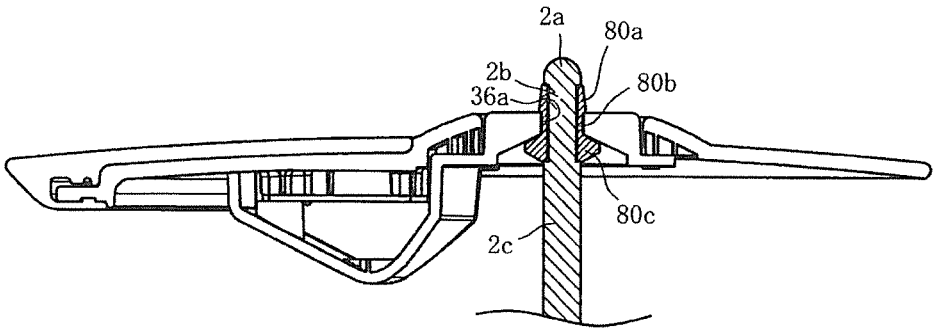
FIG. 4B is a vertical cross-sectional view of the left vertical rod, stopper, and crash cymbal.

The crash cymbal 36 is connected to a top end of the left vertical rod 222. Hereinafter, the left vertical rod 222 and the crash cymbal 36 are described with reference to FIGS. 4A and 4B. FIG. 4A is a perspective exploded view where a stopper 80 and the crash cymbal 36 are removed from the left vertical rod 222. In addition, FIG. 4B is a vertical cross-sectional view of the left vertical rod 222, the stopper 80, and the crash cymbal 36.

As shown in FIG. 4A, the left vertical rod 222 is composed of a first rod 1, a second rod 2, and a connection metal fixture 3. The connection metal fixture 3 connects the second rod 2 with the first rod 1, wherein the second rod 2 is foldable with respect to the first rod 1. The first rod 1 is composed of a base part 1*a*, a bent part 1*b*, and an offset part 1*c*. The base part 1*a* extends in the vertical direction from the left vertical pipe 221. The bent part 1*b* is bent to a transverse direction from the base part 1*a*. The offset part 1*c* is extended from the bent part 1*b* to the connection metal fixture 3. The second rod 2 is composed of a front end part 2*a*, a ventral part 2*b*, and a connection part 2*c*. The ventral part 2*b* has a diameter smaller than a diameter of the front end part 2*a*, and the connection part 2*c* has a diameter larger than the diameter of the ventral part 2*b*.

The connection metal fixture 3 is formed to have a U shape. The connection metal fixture 3 clamps an end of the offset part 1*c* of the first rod 1 and is connected with the first rod 1 by a bolt. Moreover, an end of the connection part 2*c* of the second rod 2 is welded to an inner surface of the connection metal fixture 3. Thus, with the bolt of the connection metal fixture 3 as the rotation axis, an angle between the offset part 1*c* of the first rod 1 and the second rod 2 can be adjusted.

Here, when the first rod 1 is not provided with the offset part 1*c*, the base part 1*a* of the first rod 1 has to be moved to a juncture portion between the offset part 1*c* and the connection metal fixture 3 in order to install the crash cymbal 36 at the same position. In order to do that, however, the left post 22 needs to be moved to the position of the juncture portion, which will cause the left transverse frame 24 to be extended in the rear direction. In that case, the size of the stand 20 increases. It may also be considered to connect the connection metal fixture 3 with one end of the base part 1*a* of the first rod 1 without moving the base part 1*a* of the first rod 1. In that case, however, the second rod 2 becomes shorter in length, which may have adverse influence on the vibration of the crash cymbal 36.

Considering the above, the first rod 1 is provided with the offset part 1*c*, so as to maintain the appropriate length of the second rod 2 and at the same time prevent the size of the stand 20 from increasing. In addition, the left vertical rod 222 is rotatably connected with the left vertical pipe 221. Therefore, even though the first rod 1 is provided with the offset part 1*c*, the offset part 1*c* can be rotated between the left transverse frame 24 and the right transverse frame 25 when folded. Accordingly, the first rod 1 does not protrude out in the width direction.

The stopper 80 is made of rubber and has a tubular shape. The stopper 80 is installed to press the ventral part 2*b* of the second rod 2. An internal diameter of the stopper 80 is smaller than the ventral part 2*b* of the second rod 2. Moreover, the front end part 2*a* of the second rod 2 is formed to be larger than an external diameter of the ventral part 2*b*, so that the stopper 80 is difficult to be removed from the ventral part 2*b* of the second rod 2.

Further, as illustrated in FIG. 4B, the stopper 80 is composed of a top part 80*a*, a ventral part 80*b*, and a bottom part 80*c* in sequence from a front end side thereof. An external diameter of the top part 80*a* is larger than an internal diameter of an insertion hole 36*a* that is through the crash cymbal 36. An external diameter of the ventral part 80*b* is smaller than the external diameter of the top part 80*a*. An external diameter of the bottom part 80*c* is larger than the external diameter of the top part 80*a*.

Therefore, the top part 80*a* of the stopper 80 may be compressed when the second rod 2 is inserted into or removed from the insertion hole 36*a* of the crash cymbal 36. In other words, the crash cymbal 36 can be installed or removed easily. Moreover, the diameter of the bottom part 80*c* of the stopper 80 is larger than the diameter of the top part 80*a*, so that the crash cymbal 36 is securely locked to the bottom part 80*c* of the stopper 80 when installed.

For the descriptions hereinafter, FIG. 1 to FIG. 3 are referred to again. An attachment 23*b* is connected to the lowest portion of the right post 23 by a handled clamp 23*a*. In addition, a kick pedal 60 (see FIG. 1) is connected with the attachment 23*b*. By loosening a handled screw of the handled clamp 23*a*, the attachment 23*b* can be rotated with the right post 23 as the rotation axis.

Moreover, as mentioned above, the stand 20 is set up like the letter "V" with the central post 21, which is installed on the side of the player, at the vertex of "V." Thus, there is space on two sides of the central post 21 (near the base of the left post 22 and near the base of the right post 23) for installing the kick pedal 60, which is handy for the user.

In addition, above the handled clamp 23*a*, a kick pad 38 is connected to the right post 23 by a handled clamp 23*c*. The kick pad 38 is to be hit by a beater (striking part) of the kick pedal 60. And, by loosening the handle of the handled clamp 23*c*, the kick pad 38 can be rotated with the right post 23 as the rotation axis.

Similarly, the kick pad 38 is connected with the right post 23 and mounted to the stand 20, which not only reduces the overall production costs of the electronic drum set 10 but also improves the stability during performance, in comparison with the case of installing the kick pad 38 independently from the stand 20.

The second torn 33 and the third tom 34 are connected to the right vertical pipe 231 sequentially from the bottom. The second tom 33 is connected with the right vertical pipe 231 by a handled T-shaped clamp 231*a*, connected with the right vertical pipe 231, and a transverse arm 231*b*. The handled T-shaped clamp 231*a* connects the right vertical pipe 231 and the transverse arm 231*b*. By loosening a handled screw that fastens the right vertical pipe 231, the transverse arm 231*b* together with the second torn 33 can be rotated with the right vertical pipe 231 as the rotation axis.

Moreover, the length of the transverse arm 231*b*, from the right vertical pipe 231 to a front end of the transverse arm 231*b*, is shorter than the length of the right transverse frame 25. Also, as described hereinafter, the second tom 33 can be slid along the transverse arm 231*b*. That is to say, the length from the right vertical pipe 231 to a front end of the second tom 33 (i.e. an edge part of the second torn 33, which is farthest from the right vertical pipe 231) can be adjusted to be shorter than the right transverse frame 25. Accordingly, by rotating the transverse arm 231*b* together with the second tom 33 around the right vertical pipe 231 serving as the rotation axis, the transverse arm 231*b* and the second tom 33 can be folded above the right transverse frame 25, so as to fold the electronic drum set 10 compactly in the width direction.

Furthermore, a connection part 33*a* (see FIG. 3), through which the transverse arm 231*b* is inserted and which is fastened by a bolt, is provided at a rear side of the second torn 33. By loosening the bolt using the specialized drum key, the second torn 33 can be rotated around the axis of the transverse arm 231*b*, which extends in the horizontal direction, such that a drumhead of the second torn 33 can be folded to be approximately in parallel to the vertical direction, thereby folding the electronic drum set 10 compactly in the width direction. In addition, the second torn 33 can be slid along the transverse arm 231*b*, so as to adjust the position of the second torn 33 on the transverse arm 231*b*.

The third tom 34 is connected with the right vertical pipe 231 by a transverse arm 231*c* having one end welded with the right vertical pipe 231. Because one end of the transverse arm 231*c* is welded with the right vertical pipe 231, the production costs of the stand 20 are reduced and further the strength of the stand 20 can be improved.

Moreover, the length of the transverse arm 231*c*, from the right vertical pipe 231 to the front end of the transverse arm 231*c*, is shorter than the right transverse frame 25. Also, as described below, the third torn 34 is slidable along the transverse arm 231*c*. That is to say, the length from the right vertical pipe 231 to the front end of the third tom 34 (i.e. an edge part of the third tom 34, which is farthest from the right vertical pipe 231) can be adjusted to be shorter than the right transverse frame 25. And, as mentioned above, by using the specialized drum key to loosen the clamp 23*d*, the right vertical pipe 231 can be rotated around the vertical axis of the right post 23. Therefore, by rotating the right vertical pipe 231 around the vertical axis of the right post 23, the transverse arm 231*c* and the third tom 34 can be folded above the right transverse frame 25, so as to fold the electronic drum set 10 compactly in the width direction.

In addition, the length of the transverse arm 231*c* is approximately the same as the length of the transverse arm 221*e* (to which the first tom 32 is connected) welded to the left vertical pipe 221. Thus, the right vertical pipe 231, to which the transverse arm 231*c* is welded, and the left vertical pipe 221, to which the transverse arm 221*e* is welded, can be standardized.

Further to the above, a connection part 34*a* (see FIG. 3), through which the transverse arm 231*c* is inserted and which is fastened by a bolt, is provided at a rear side of the third tom 34. By loosening the bolt using the specialized drum key (not shown in the figure), the third tom 34 can be rotated around the axis of the transverse arm 231*c*, which extends in the horizontal direction, such that a drumhead of the third tom 34 can be folded to be approximately in parallel to the vertical direction, thereby folding the electronic drum set 10 compactly in the width direction. In addition, the third tom 34 can be slid along the transverse arm 231*c*, so as to adjust the position of the third torn 34 on the transverse arm 231*c*.

Additionally, as described above, the second tom 33 can be slid along the transverse arm 231*b*. That is, the length from the right vertical pipe 231 to the third tom 34 can be adjusted to be shorter than the length from the right vertical pipe 231 to the second tom 33. Thus, when the stand 20 is folded, an overlap of the second tom 33 and the third torn 34 in the width direction is reduced. In other words, the size of the electronic drum set 10 in the width direction is prevented from increasing when the electronic drum set 10 is in the folded state.

The ride cymbal 37 is connected to a top end of the right vertical rod 232. The ride cymbal 37 is connected to the right vertical rod 232 in the same way that the crash cymbal 36 is connected to the left vertical rod 222 (see FIGS. 4A and 4B). Thus, detailed descriptions thereof are omitted.

A folding procedure for folding the aforementioned electronic drum set 10 is exemplified below with reference to FIGS. 5A, 5B to FIGS. 9A, 9B. First, as illustrated in FIG. 5A, the sound source 40 is rotated toward an arrow A direction. For the handled T-shaped clamp 221*a*, the bolt that fastens the transverse arm 221*b* (see FIG. 3) is loosened using the specialized drum key. And, the transverse arm 221*b* together with the sound source 40 is rotated toward the arrow A direction.

Figure 5B:
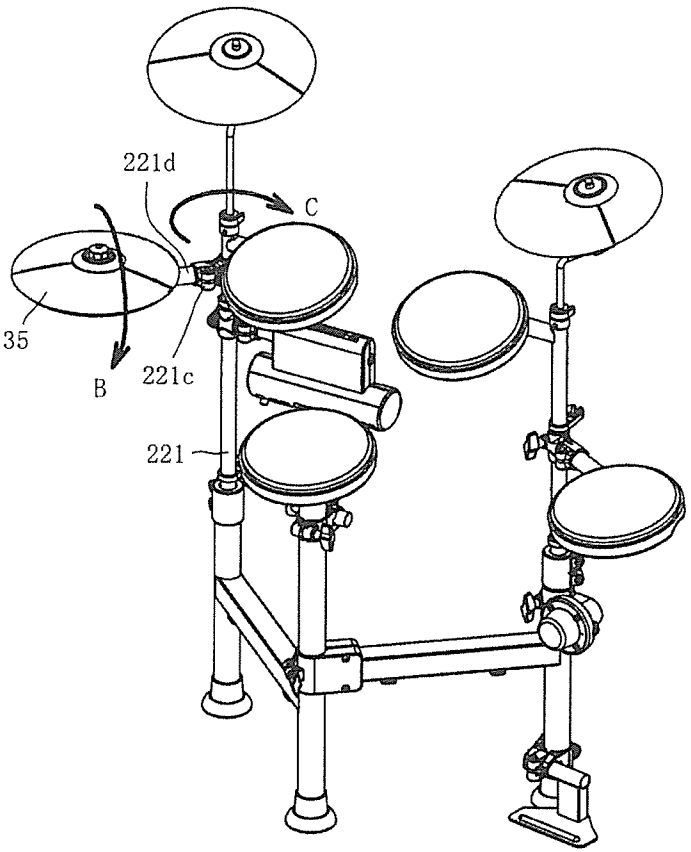
FIG. 5B is a figure illustrating a step of the folding procedure for folding the electronic drum set.
Figure 5A:
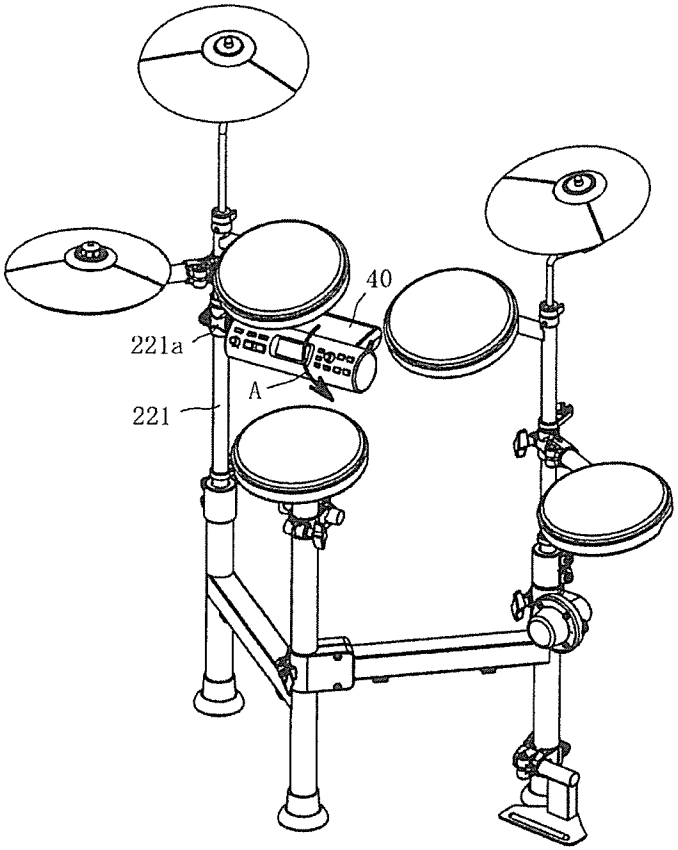
FIG. 5A is a figure illustrating a step of the folding procedure for folding the electronic drum set.

Next, as illustrated in FIG. 5B, the hi-hat 35 is rotated toward an arrow B direction and also toward an arrow C direction. For the handled T-shaped clamp 221*c*, the bolt that fastens the transverse arm 221*d* is loosened using the specialized drum key. And, the transverse arm 221*d* together with the hi-hat 35 is rotated toward the arrow B direction. Moreover, for the handled T-shaped clamp 221*c*, the handled screw that fastens the left vertical pipe 221 is loosened, and the transverse arm 221*c* together with the hi-hat 35 is rotated toward the arrow C direction.

Figure 6B:
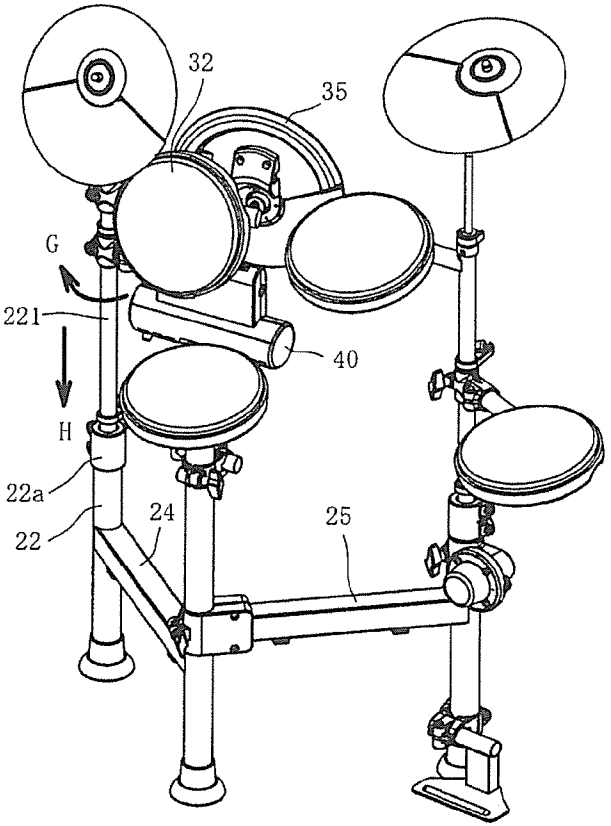
FIG. 6B is a figure illustrating a step of the folding procedure for folding the electronic drum set.
Figure 6A:
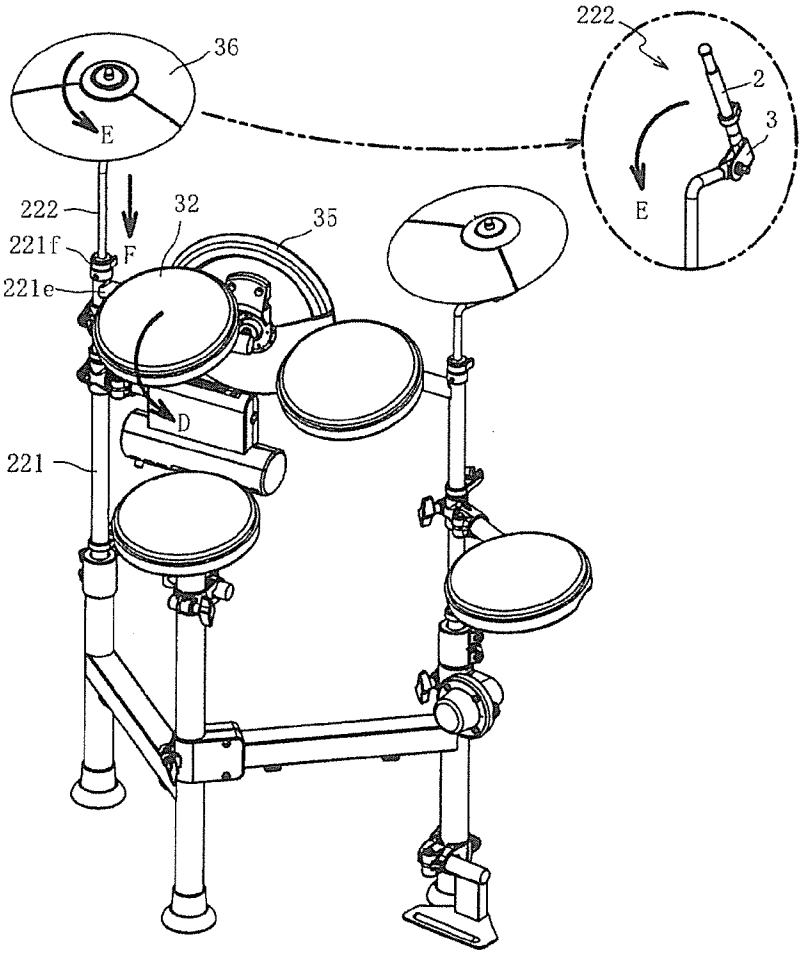
FIG. 6A is a figure illustrating a step of the folding procedure for folding the electronic drum set.

Then, as shown in FIG. 6A, the first torn 32 is rotated toward an arrow D direction. The bolt of the connection part 32*a* (see FIG. 3) located at the rear side of the first tom 32 is loosened using the specialized drum key, and the first torn 32 is rotated toward the arrow D direction. As a result, the first tom 32 and the hi-hat 35 become opposite to each other. However, since their lengths from the left vertical pipe 221 are not the same, the first tom 32 and the hi-hat 35 do not completely overlap each other. According to the above, the size of the stand 20 in the width direction can be prevented from increasing.

Further, the crash cymbal 36 is rotated toward an arrow E direction. That is, the bolt of the connection metal fixture 3, that constitutes a part of the left vertical rod 222 to which the crash cymbal 36 is connected, is loosened, and the second rod 2 is rotated toward the arrow E direction, such that the crash cymbal 36 becomes approximately parallel to the vertical direction. Besides, the left vertical rod 222 is slid toward an arrow F direction. The clamp 221*f* provided with the lever is operated so as to receive the left vertical rod 222 inside the left vertical pipe 221.

Thereafter, as illustrated in FIG. 6B, the left vertical pipe 221 is rotated toward an arrow G direction and at the same time slid toward an arrow H direction. That is, the clamp 22*a* which fastens the left vertical pipe 221 is loosened, so as to rotate the left vertical pipe 221 toward the arrow G direction and slide the left vertical pipe 221 toward the arrow H direction. Accordingly, the left vertical pipe 221 is received inside the left post 22.

Herein, when the left vertical pipe 221 is rotated toward the arrow G direction, the first tom 32, the hi-hat 35, and the sound source 40 are rotated to be positioned above the left transverse frame 24, so as to fold the first torn 32, the hi-hat 35, and the sound source 40 in the space between the left transverse frame 24 and the right transverse frame 25. According to this exemplary embodiment, there is space above the left transverse frame 24. Therefore, no component needs to be removed when the first torn 32, the hi-hat 35, and the sound source 40 are rotated, which is convenient.

Figure 7B:
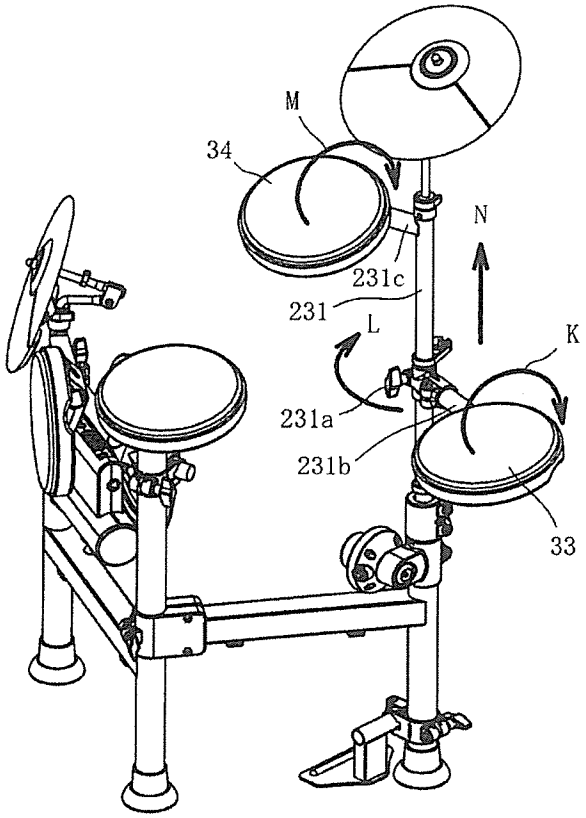
FIG. 7B is a figure illustrating a step of the folding procedure for folding the electronic drum set.
Figure 7A:
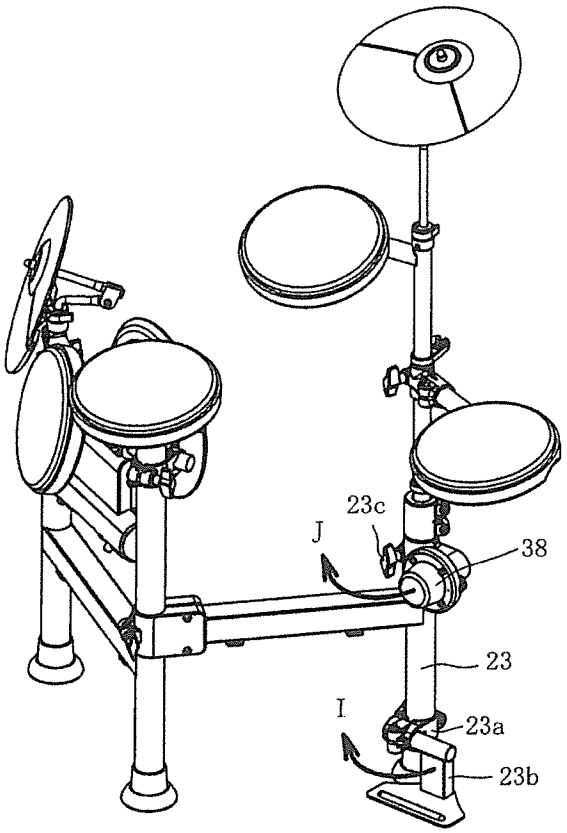
FIG. 7A is a figure illustrating a step of the folding procedure for folding the electronic drum set.

Following that, as shown in FIG. 7A, the attachment 23*b* is rotated toward an arrow I direction, and the kick pad 38 is rotated toward an arrow J direction. That is, the handled screw of the handled clamp 23*a* is loosened, so as to rotate the attachment 23*b* toward the arrow I direction. And, the handled screw of the handled clamp 23*c* is loosened, so as to rotate the kick pad 38 toward the arrow J direction.

Next, as shown in FIG. 7B, the second tom 33 is rotated toward an arrow K direction. The transverse arm 231*b* and the second torn 33 are rotated toward an arrow L direction. The third torn 34 is rotated toward an arrow M direction. Then, the transverse arm 231*b* and the second torn 33 are lifted toward an arrow N direction.

The bolt of the connection part 33*a* (see FIG. 3) located at the rear side of the second tom 33 is loosened using the specialized drum key, and the second torn 33 is rotated toward the arrow K direction. Additionally, with respect to the handled T-shaped clamp 231*a*, the handled screw that fastens the right vertical pipe 231 is loosened, and the transverse arm 231*b* together with the second torn 33 is rotated toward the arrow L direction. Then, the bolt of the connection part 34*a* (see FIG. 3) located at the rear side of the third torn 34 is loosened using the specialized drum key, and the third torn 34 is rotated toward the arrow M direction. The handled screw of the handled T-shaped clamp 231*a*, which fastens the right vertical pipe 231, is already loosened. Accordingly, the transverse arm 231*b* and the second tom 33 are slid upward (the arrow N direction) along the right vertical pipe 231.

As a result, the second torn 33 and the third tom 34 become opposite to each other as well. However, since their lengths from the right vertical pipe 231 are not the same, the second torn 33 and the third torn 34 do not completely overlap each other. According to the above, the size of the stand 20 in the width direction can be prevented from increasing.

Figure 8B:
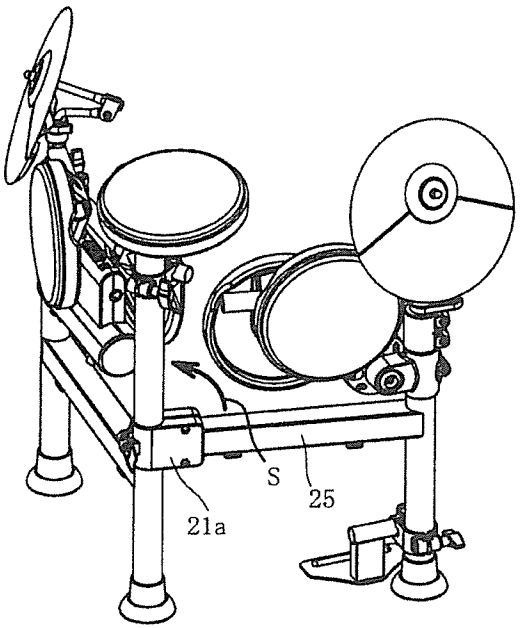
FIG. 8B is a figure illustrating a step of the folding procedure for folding the electronic drum set.
Figure 8A:
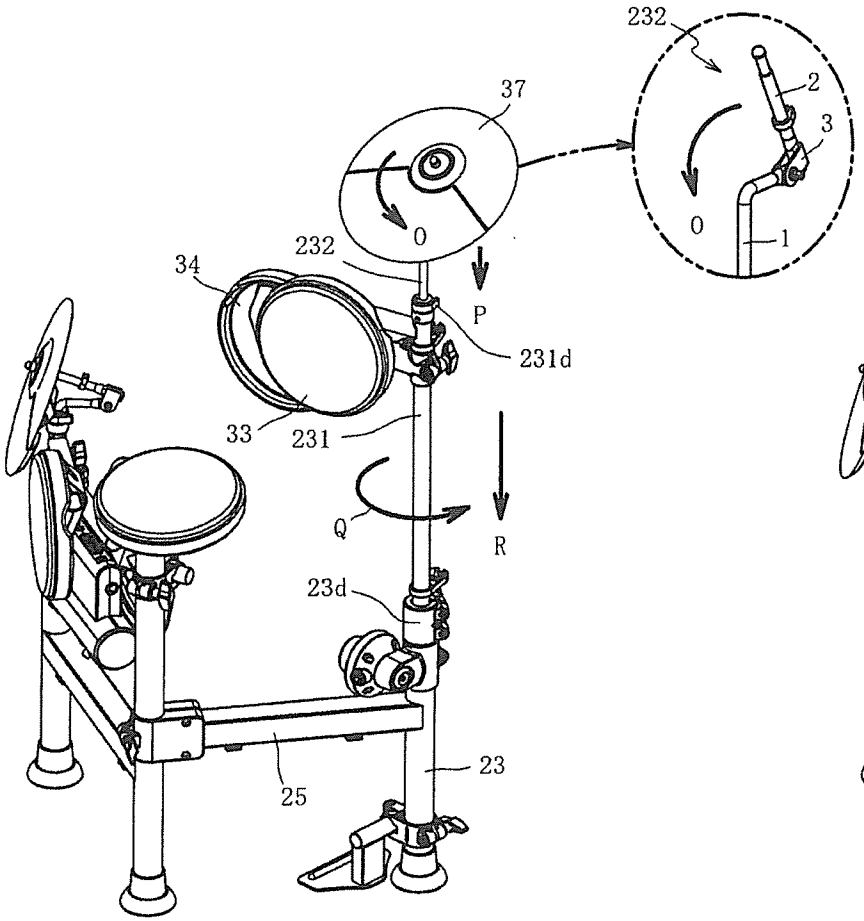
FIG. 8A is a figure illustrating a step of the folding procedure for folding the electronic drum set.

Next, as shown in FIG. 8A, the ride cymbal 37 is rotated toward an arrow O direction. Specifically, the same as the crash cymbal 36, the bolt of the connection metal fixture 3, that constitutes a part of the right vertical rod 232 to which the ride cymbal 37 is connected, is loosened, and the second rod 2 is rotated toward the arrow O direction, such that the ride cymbal 37 becomes approximately parallel to the vertical direction. Besides, the right vertical rod 232 is slid toward an arrow P direction. Namely, the clamp 231*d* provided with the lever is operated so as to receive the right vertical rod 232 inside the right vertical pipe 231. Furthermore, the clamp 23*d* that fastens the right vertical pipe 231 is loosened, and the right vertical pipe 231 is rotated toward an arrow Q direction and slid toward an arrow R direction, so as to be received in the right post 23.

When the right vertical pipe 231 is rotated toward the arrow Q direction, the second tom 33 and the third tom 34 are rotated to be positioned above the right transverse frame 25, so as to fold the second tom 33 and the third tom 34 in the space between the left transverse frame 24 and the right transverse frame 25. According to this exemplary embodiment, there is space above the right transverse frame 25. Therefore, no component needs to be removed when the second tom 33 and the third torn 34 are rotated, which is convenient.

Lastly, as shown in FIG. 8B, the handled clamp 21*a* is loosened, and the right transverse frame 25 is rotated toward an arrow S direction. Following the above folding procedure, the electronic drum set 10 can be folded compactly as illustrated in FIG. 9A. That is, the various pads, i.e. the sound source 40, the hi-hat 35, the first tom 32, the attachment 23*b*, the second tom 33, and the third tom 34, are stored between the left transverse frame 24 and the right transverse frame 25. Moreover, the crash cymbal 36 and the ride cymbal 37 are folded in a state that is approximately parallel to the vertical direction.

Figure 9B:
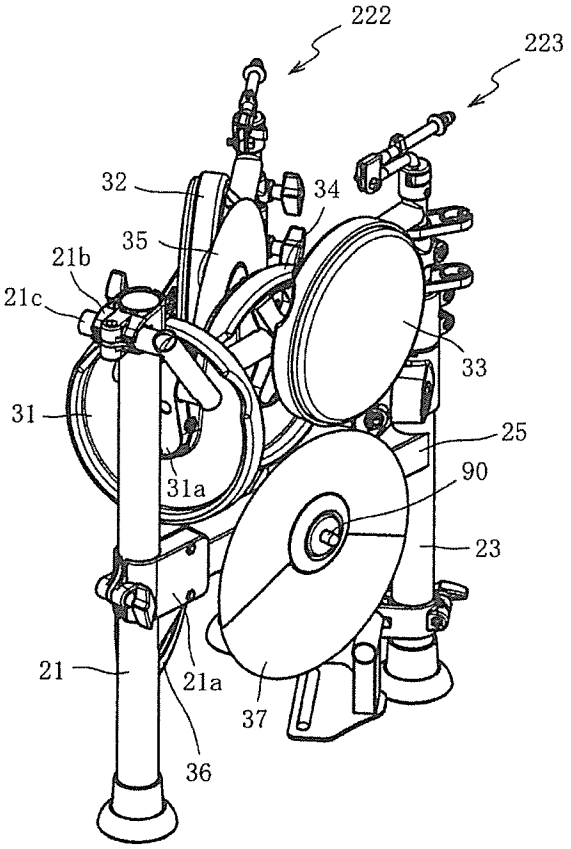
FIG. 9B is a perspective view illustrating another folded state of the electronic drum set, which is different from the folded state of FIG. 9A.
Figure 9A:
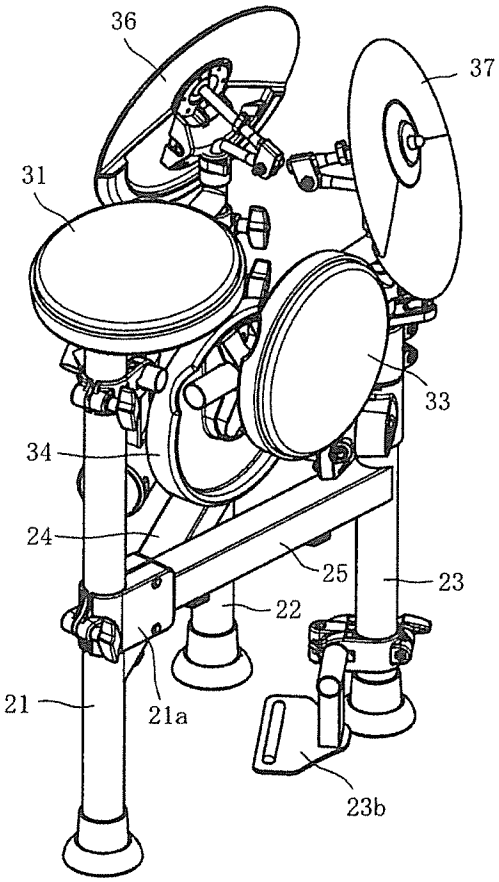
FIG. 9A is a perspective view illustrating a folded state of the electronic drum set.

Furthermore, FIG. 9B is a perspective view illustrating another folded state of the electronic drum set 10, which is different from the folded state of FIG. 9A. Referring to FIG. 9B, a projection 90 is disposed upright on an external side of the left transverse frame 24 and an external side of the right transverse frame 25 respectively. The projection 90 has an external diameter which allows the projection 90 to be inserted into the insertion hole 36*a* (see FIG. 4A) that penetrates the crash cymbal 36 and the ride cymbal 37. Then, the projections are respectively inserted into the insertion hole 36*a* of the crash cymbal 36 and the insertion hole of the ride cymbal 37, so as to hang the crash cymbal 36 and the ride cymbal 37 on the left transverse frame 24 and the right transverse frame 25 respectively.

Moreover, the snare drum 31 is folded as shown in FIG. 9B. Namely, the bolt of the connection part 31*a* at the rear side of the snare drum 31 is loosened with use of the specialized drum key. Then, the snare drum 31 is rotated toward the direction that the player faces (direction F, see FIG. 1) inner side with the upper pipe of the U-shaped connection pipe 21*c* as the rotation axis, so that a drumhead of the snare drum 31 is approximately parallel to the vertical direction. In addition, the handled T-shaped clamp 21*b* that fastens the lower pipe of the U-shaped connection pipe 21*c* is loosened, and the snare drum 31 is rotated toward the direction that the player faces (direction F, see FIG. 1) the inner side with the lower pipe of the U-shaped connection pipe 21*c* as the rotation axis. By doing so, the electronic drum set 10 can also be folded to be compact in size.

The present invention is described based on the foregoing exemplary embodiments. However, it should be understood that the present invention is not limited to the disclosure of these exemplary embodiments, and various modifications or alterations may be made to the present invention without departing from the spirit of the present invention.

The above exemplary embodiments illustrate that the right post 23, the transverse arm 221*d*, etc. are rotatable, the left vertical pipe 221, etc. is formed to be expandable/retractable, and the electronic drum set 10 is formed to be foldable. Nevertheless, these components may also be unrotatable or unexpandable/unretractable. For example, the right transverse frame 25 may be welded to the central post 21 to make the right post 23 not rotatable, the transverse arm 221*d* may be welded to the left vertical pipe 221 to be unrotatable, and the left vertical pipe 221 may be welded to the left post 22 to be unexpandable/unretractable.

Although the above exemplary embodiments illustrate that the transverse arms 221*e* and 231*c*, which support the first tom 32 and the third tom 34, are welded to the left vertical pipe 221 and the right vertical pipe 231, other transverse arms may be welded. For instance, the transverse arms 221*d* and 231*b*, which support the hi-hat 35 and the second torn 33, may be welded to the left vertical pipe 221 and the right vertical pipe 231 respectively, or on the contrary, the transverse arms 221*e* and 231*c* may not be welded but connected by handled T-shaped clamps, for example.

Further, although the above exemplary embodiments illustrate that the left transverse frame 24 is welded to the left post 22 and the central post 21, and the right transverse frame 25 is welded to the right post 23 and connected to the central post 21 by the handled clamp 21*a*, the present invention is not limited thereto. The foregoing may all be connected using handled clamps or all welded, or the left transverse frame 24 may be connected with the central post 21 by the handled clamp.

Also, the above exemplary embodiments illustrate that the central post 21 and the snare drum 31 are connected by the handled T-shaped clamp 21*b* and the U-shaped connection pipe 21*c*, but the present invention is not limited thereto. For example, the upper pipe of the U-shaped connection pipe 21*c* may be omitted and the snare drum 31 may be connected thereto directly. Moreover, the lower pipe of the U-shaped connection pipe 21*c* may be omitted and the central post 21 may be connected thereto directly. The handled T-shaped clamp 21*b* and the U-shaped connection pipe 21*c* may also be omitted. In that case, the central post 21 and the snare drum 31 may be connected by another connection means (e.g. a ball clamp, etc.) which allows the snare drum 31 to pivot freely in at least one direction. Since the force brought by the hit on the snare drum 31 can be absorbed by the central post 21, the stand 20 is prevented from tilting and falling toward the side of the player.

In addition, the above exemplary embodiments illustrate that the kick pad 38, the handled clamp 23*a*, and the attachment 23*b* are attached to the right post 23, but the present invention is not limited thereto. The hi-hat 35 and the second torn 33 may be exchanged, and the kick pad 38, the handled clamp 23*a*, and the attachment 23*b* may be attached to the left post 22 instead. Moreover, a part of the attachment 23*b*, which is fastened by the handled clamp 23*a*, may be extensibly installed on the left and right sides. In that case, the kick pad 38 may be hit by the left foot, which is more flexible for the player.

Although the electronic drum set 10 is illustrated in the above exemplary embodiments, the present invention may be a percussion instrument that includes no sensor for sensing hits. For example, the present invention may include a percussion instrument imitating a drum set of acoustic drums or a practice drum set.

The above exemplary embodiments illustrate that the second torn 33 can be slid along the transverse arm 231*b* and the third tom 34 can be slid along the transverse arm 231*c*, for example, for adjusting the positions of the second tom 33 and the third tom 34 relative to the right vertical pipe 231, but the present invention is not limited thereto. For instance, the transverse arms 231*b* and 231*c* may be made expandable/retractable, such that the positions of the second tom 33 and the third tom 34 relative to the right vertical pipe 231 are adjustable.

In addition, the folding procedure of the electronic drum set 10 is not limited to the steps described in the above exemplary embodiments. For example, the electronic drum set 10 may be folded starting from the right side. Besides, the left vertical rod 222 and the left vertical pipe 221 may be retracted before the transverse arm 221*d*, etc. is folded. And, the various pads 31-38 may be removed to fold the stand 20 and the transverse arms 221*b* and 221*d*, etc.

In the above exemplary embodiments, a through hole of the stopper 80 is circular. Nevertheless, the stopper 80 may be formed into an elliptical shape, for example, so that the stopper 80 has the rotation-stop function.

The above exemplary embodiments illustrate that the sound source 40 and the hi-hat 35 are unslidably attached to the transverse arms 221*b* and 221*d* while the first tom 32, the second tom 33, and the third tom 34 are slidable along the transverse arms 221*e*, 231*b*, and 231*c*; however, the present invention is not limited thereto. The sound source 40 and the hi-hat 35 may be slidably attached to the transverse arms 221*b* and 221*d*. In that case, the respective lengths from the left vertical pipe 221 to the sound source 40 and the hi-hat 35 may be longer or shorter than the left transverse frame 24 during performance, and the lengths are adjusted to be shorter than the left transverse frame 24 when the electronic drum set 10 is folded. In addition, the first tom 32, the second tom 33, and the third tom 34 may be unslidably attached to the transverse arms 221*e*, 231*b*, and 231*c*. In that case, the first tom 32 is fixed beforehand to make the length from the left vertical pipe 221 to the first tom 32 shorter than the length of the left transverse frame 24, and the second tom 33 and the third tom 34 are fixed to make the respective lengths from the right vertical pipe 231 to the second tom 33 and the third tom 34 shorter than the length of the right transverse frame 25.

What is claimed is:

1. A percussion instrument, comprising:

at least one pad; and a support frame supporting the at least one pad and comprising:

a central vertical frame;

a left vertical frame installed upright in the vertical direction and located in a left rear direction relative to the central vertical frame when viewed from a player side;

a right vertical frame installed upright in the vertical direction and located in a right rear direction relative to the central vertical frame when viewed from the player side;

a left transverse frame extending between the central vertical frame and the left vertical frame and connecting the central vertical frame with the left vertical frame; and a right transverse frame extending between the central vertical frame and the right vertical frame and connecting the central vertical frame with the right vertical frame.

2. The percussion instrument according to claim 1, further comprising:

a first arm extending in a horizontal direction, to a middle of which the at least one pad is connected, and connected to each of a plurality of side vertical frames, wherein the side vertical frames comprise the left vertical frame and the right vertical frame;

the side vertical frames and the first arm are connected with each other in a manner that at least one of the side vertical frames and the first arm is rotatable around a vertical axis of the side vertical frames;

the first arm and the at least one pad connected to the first arm are connected with each other in a manner that at least one of the first arm and the at least one pad connected to the first arm is rotatable around a horizontal axis of the first arm; and the left transverse frame and the right transverse frame are connected to the central vertical frame in a manner that at least one of the left transverse frame and the right transverse frame is rotatable around the central vertical frame.

3. The percussion instrument according to claim 2, further comprising:

a second arm, different from the first arm, extending in the horizontal direction, to a middle of which the at least one pad is connected, and connected to each of the side vertical frames, wherein the side vertical frames and the second arm are connected with each other in a manner that at least one of the side vertical frames and the second arm is rotatable around the vertical axis of the side vertical frames;

a portion of the side vertical frames, to which the first arm and the second arm are connected, is expandable and retractable;

the first arm and the second arm are slidable along the side vertical frames to a position where the at least one pad connected to one of the first arm and the second arm overlaps the at least one pad connected to the other one of the first arm and the second atm in the vertical direction; and a first length from the side vertical frames to the at least one pad connected to the first arm, and a second length from the side vertical frames to the at least one pad connected to the second atm are adjustable to differ from each other, or the first length and the second length are unadjustably fixed beforehand in a way that the first length and the second length are different.

4. The percussion instrument according to claim 1, further comprising an attachment connected to a lower part of the left vertical frame or the right vertical frame for installing a kick pedal that hits the at least one pad when kicked by a foot of the player.

5. The percussion instrument according to claim 2, wherein the first arm connected to the left vertical frame is shorter than the left transverse frame, and the first arm connected to the right vertical frame is shorter than the right transverse frame.

6. The percussion instrument according to claim 1, further comprising:

a first arm extending in a horizontal direction, to a middle of which the at least one pad is connected, and connected to each of a plurality of side vertical frames, wherein the side vertical frames comprise the left vertical frame and the right vertical frame, wherein the side vertical frames and the first arm are connected in a manner that at least one of the side vertical frames and the first arm is rotatable around a vertical axis of the side vertical frames.

7. The percussion instrument according to claim 1, further comprising:

a first arm extending in a horizontal direction, to a middle of which the at least one pad is connected, and connected to each of a plurality of side vertical frames, wherein the side vertical frames comprise the left vertical frame and the right vertical frame, wherein the first arm and the at least one pad connected to the first arm are connected with each other in a manner that at least one of the first arm and the at least one pad connected to the first arm is rotatable around a horizontal axis of the first arm.

8. The percussion instrument according to claim 1, wherein the left transverse frame and the right transverse frame are connected to the central vertical frame in a manner that at least one of the left transverse frame and the right transverse frame is rotatable around the central vertical frame.

9. The percussion instrument according to claim 1, wherein one of the left transverse frame and the right transverse frame is unrotatably connected to the central vertical frame while the other one of the left transverse frame and the right transverse frame is connected to the central vertical frame in a manner that the other one of the left transverse frame and the right transverse frame is rotatable about the central vertical frame.

10. The percussion instrument according to claim 2, wherein a first length from the left vertical frame to a farthest edge part of the at least one pad connected to the first arm connected to the left vertical frame is shorter than the left transverse frame, and a second length from the right vertical frame to a farthest edge part of the at least one pad connected to the first arm connected to the right vertical frame is shorter than the right transverse frame, or the at least one pad is unadjustably fixed beforehand such that the first and second lengths are respectively shorter than the left transverse frame and the right transverse frame.

11. The percussion instrument according to claim 4, wherein the at least one pad hit by the kick pedal is connected to the left vertical frame or the right vertical frame that is connected with the attachment.

12. A stand for percussion instrument, supporting at least one pad, the stand comprising:

a central vertical frame installed upright in a vertical direction and grounded;

a left vertical frame connected to the central vertical frame and installed upright in the vertical direction and located in a left rear direction relative to the central vertical frame and grounded at the left rear direction relative to the central vertical frame; and a right vertical frame connected to the central vertical frame and installed upright in the vertical direction and located in a right rear direction relative to the central vertical frame and grounded at the right rear direction relative to the central vertical frame.

13. The stand according to claim 12, wherein the central vertical frame is connected to one of the at least one pad.

14. The stand according to claim 13, wherein the one of the at least one pad is configured onto an upper end of the central vertical frame.

15. The stand according to claim 12, wherein the at least one of the left vertical frame and the right vertical frame is rotatable around the central vertical frame.

16. The stand according to claim 12, further comprising a vertical pipe connected to the left vertical frame or the right vertical frame in a manner that the vertical pipe is able to be accommodated in an upper portion of the left vertical frame or an upper portion of the right vertical frame.

17. The stand according to claim 16, further comprising an arm connected to the at least one pad, wherein the arm is horizontally connected to the vertical pipe.

18. The stand according to claim 17, wherein the arm is slidable connected to the vertical pipe.

19. The stand according to claim 16, further comprising a rod connected to an upper portion of the vertical pipe, wherein one of the at least one pad is cymbal pad and the rod is connected to the cymbal pad.

20. The stand according to claim 19, wherein the rod is connected to the vertical pipe in a manner that the rod is able to be accommodated in an upper portion of the vertical pipe.

* * * * *